US006892661B2

(12) United States Patent
Kishi et al.

(10) Patent No.: US 6,892,661 B2
(45) Date of Patent: May 17, 2005

(54) STEERING DEVICE

(75) Inventors: Seiichi Kishi, Kobe (JP); Tsukasa Yoshida, Kobe (JP); Yuji Ito, Kobe (JP); Kenji Ito, Kobe (JP); Kenichi Sonoda, Kobe (JP); Kazutoshi Soga, Kobe (JP); Nobuyasu Takahashi, Ibaraki (JP)

(73) Assignees: Morol Co., Ltd., Hyogo (JP); The New Industry Research Organization, Hyogo (JP)

( * ) Notice: Subject to any disclaimer, the term of this patent is extended or adjusted under 35 U.S.C. 154(b) by 0 days.

(21) Appl. No.: 10/480,938

(22) PCT Filed: Jun. 29, 2001

(86) PCT No.: PCT/JP01/05680

§ 371 (c)(1),
(2), (4) Date: Dec. 16, 2003

(87) PCT Pub. No.: WO03/002408

PCT Pub. Date: Jan. 9, 2003

(65) Prior Publication Data

US 2004/0139900 A1 Jul. 22, 2004

(51) Int. Cl.[7] ..... B63H 25/00
(52) U.S. Cl. ..... 114/144 R; 40/58
(58) Field of Search ..... 114/144 R; 440/58, 440/60, 61 R

(56) References Cited

U.S. PATENT DOCUMENTS 4,419,084 A * 12/1983 Borst ..... 440/58
4,735,165 A * 4/1988 Baba et al. ..... 114/144 R
5,127,856 A * 7/1992 Kabuto et al. ..... 440/60
5,387,142 A * 2/1995 Takayanagi et al. ..... 440/61 R

* cited by examiner

*Primary Examiner*—Lars A. Olson
(74) *Attorney, Agent, or Firm*—William H. Holt

(57) ABSTRACT

The steering apparatus in which at least part of the transmission lines (L1, L3) which transmit the control quantity of steering from the steering wheel (20, 120, 220) to the rudder (30, 130, 230) is constituted from a steering cable such as wire so as to steer the rudder by transmitting the control quantity of operating the steering wheel to the rudder through reciprocal motion of the transmission line. The assisting force supplying means (70, 170, 270) is additionally installed and the intermediate linkage rod (60, 160, 260) is installed to interpose in the transmission line, with the transmission line (L2) for transmitting the assisting force supplied from the assisting force supplying means being connected to said intermediate linkage rod in addition to the transmission lines described above, so that the intermediate linkage rod is moved back and forth by the sum of the manual force from said steering wheel and the assisting force from the assisting force supplying means, thereby to steer the rudder.

5 Claims, 9 Drawing Sheets

(A)

(B)

STEERING DEVICE

TECHNICAL FIELD

The present invention relates to a steering apparatus, and more particularly to a steering apparatus that can be preferably employed as the steering apparatus of mid to small vessels.

BACKGROUND ART

Among steering apparatuses commonly used in mid to small vessels such as motorboats and pleasure boats, there are such apparatuses that transmit the operating motions of the steering wheel via steering cable such as wire to the rudder.

FIG. 9 shows a typical example of steering apparatus of the prior art which employs the steering cable.

A vessel 1 is provided with a steering wheel 2 for maneuvering the vessel. A rudder 3 is provided at the stern apart from the steering wheel 2. The steering wheel 2 and the rudder 3 are connected with a transmission line 4 consisting of a steering cable.

The rudder 3 in this case is constituted from an outboard engine which consists of an engine 3*a* and a screw 3*b*.

When an operator operates the steering wheel 2, the transmission line 4 is drawn out or drawn in, so as to move back or forth. The transmission line 4 is connected to a rod 6 of a guide 5 so that the rod 6 moves back and forth as the transmission line 4 moves back and forth. As the rod 6 move back or forth, a lever 8 is moved via a connecting rod 7 to the left or right, so as to change the direction of the rudder 3 (outboard engine).

Such a method of steering that transmits the control quantity due to the operation of the steering wheel 2 in the form of reciprocal motion of the transmission line 4 such as steering cable to the rudder 3, as described above, has an advantage of building the apparatus very easily at a low cost. Also because it enables it to make the transmission line 4 from a flexible material such as the steering cable, the line can be installed with a higher degree of freedom. Thus the line can be routed around other units so as to avoid interference therewith.

However, since a manual steering apparatus that employs the steering cable as described above requires it to steer the rudder 4 by operating the steering wheel 2 only by the power of a human operator, there has been such a problem that it is not convenient for a weak-powered operator such as female.

Also because it requires a considerable manual force to steer, larger vessels are difficult to steer with human power. As a result, sizes of the applicable vessels are limited within certain level and the apparatus cannot be applied to larger vessels.

An object of the present invention is to provide a steering apparatus which eliminates the drawbacks of the conventional steering apparatuses and allows it to steer with a reduced force without requiring the operator to exert a strenuous effort while maintaining the advantages of the steering apparatus that employs the steering cable such as simple constitution, low cost and ease of installation.

It is another object of the present invention to provide a steering apparatus which can be applied to larger vessels than the vessels equipped with the conventional steering apparatuses employing the steering cable.

Further another object of the present invention is to provide a steering apparatus which gives the operator the real feeling of manual steering.

It is of course included in the objects of the present invention to provide a steering apparatus which ensures sufficient safety such that the rudder will never be steered only by assisting force supplying means without the operator actually operating the steering apparatus.

DISCLOSURE OF THE INVENTION

In order to achieve the objects described above, the present invention provides such a novel steering apparatus that, as an operator starts to operate a steering wheel, an assisting force is applied subserviently to the manual force exerted on the steering wheel, on the basis of such a mechanism as the steering wheel and a rudder are connected with a transmission line such as steering cable so as to transmit the operating motion of the steering wheel via the transmission line to the rudder thereby to steer the vessel.

First feature of the steering apparatus according to the present invention is that, at least a part of the transmission line that transmits the control quantity of steering motion of the steering wheel to the rudder is constituted from a steering cable such as wire, and the control quantity of steering motion of the steering wheel is transmitted to the rudder by the reciprocal motion of the transmission line so as to steer the vessel, wherein assisting force supplying means is provided so as to assist the manual force for operating the steering wheel, an intermediate linkage rod is provided to interpose at a midpoint in the transmission line, a transmission line from the steering wheel and a transmission line to the rudder are connected to the intermediate linkage rod and a transmission line for the assisting force supplied from the assisting force supplying means is connected to the intermediate linkage rod, so that the intermediate linkage rod is moved back and forth by the resultant force of synthesizing the manual force from the steering wheel and the assisting force from the assisting force supplying means, thereby to transmit the control quantity is transmitted from the steering wheel to the rudder and steer the vessel.

According to the first feature described above, manual force applied by the operator is transmitted from the steering wheel via the transmission line to the intermediate linkage rod. In addition, the assisting force applied from the assisting force supplying means is transmitted via the transmission line to the intermediate linkage rod. The manual force and the assisting force are synthesized in the intermediate linkage rod, so that the intermediate linkage rod is moved back or forth by the resultant force. The back and forth motion is transmitted via the transmission line to the rudder.

With this constitution, the operator is required only to exert a force that is the force required to move the steering wheel minus the assisting force, after the moment when the assisting force is supplied. Thus the operator can steer the vessel easily with a smaller force. The assisting force may be, in addition to a constant force, a force regulated by proportional control which will be described later, a force regulated by proportional plus integral control, a force regulated by proportional plus integral plus derivative control or the like.

The transmission line that transmits the control quantity of operating the steering wheel to the rudder may be at least partially constituted from a steering cable such as wire, to provide the advantages of the manual steering apparatus of the prior art such that the mechanism and constitution are simple and low cost.

As the transmission line is constituted from a steering cable, such advantage as the degree of freedom in installing the transmission means that transmits the control quantity of the steering wheel or driving force to the rudder is made higher without interfering with other important units can still be maintained.

In addition, feeling of manual steering can also be felt on the hand.

Also the steering apparatus can be applied to larger vessels than the vessels equipped with the conventional steering apparatuses employing the steering cable, since the manual force required of the operator can be reduced.

Second feature of the steering apparatus of the present invention is, in the constitution according to the first feature described above, that a linkage point of the transmission line from the steering wheel and a linkage point of the transmission line from the assisting force supplying means to the intermediate linkage rod are located apart from each other, and control means is provided that, when there arises a deviation from the initial state in the positional relation between these linkage points by the operation of the steering wheel, directs the assisting force supplying means to supply an assisting force in such a direction that cancels the deviation According to the second feature, the linkage point of the transmission line from the steering wheel and the linkage point of the transmission line from the assisting force supplying means to the intermediate linkage rod are in a specified positional relationship in the initial state. As the operator starts to operate the steering wheel in this initial state, the linkage point of the transmission line is moved back or forth so as to have a positional deviation from the linkage point of the transmission line coming from the assisting force supplying means. When the deviation is generated, the control means causes the assisting force supplying means to generate and apply an assisting force in such a direction as the deviation is canceled. The direction in which the deviation is canceled is the same as the direction in which the linkage point of the transmission line from the steering wheel is moved, and is therefore the same as the direction in which the manual force of the operator is applied. Accordingly, the manual force of the operator and the assisting force are applied to the intermediate linkage rod in the same direction, so that the rudder is moved by the resultant force. As a result, once the application of the assisting force is started, the operator can steer the vessel with a smaller force, namely the force required to move the rudder minus the assisting force, as long as the assisting force is applied.

The assisting force is applied as long as there is a deviation.

The deviation may be an angular difference between the two linkage points, positional deviation between moving distances between the two linkage points or the like.

Third feature of the steering apparatus of the present invention is, in the constitution according to the second feature described above, that an angular difference between the linkage point of the transmission line from the assisting force supplying means and the linkage point of the transmission line from the steering wheel is detected as the deviation.

According to the third feature, detecting the actual angular deviation provides such an advantage that relatively large variation can be detected with an angular deviation detector such as potentiometer with large signal, thereby making the subsequent signal processing and control operations easier.

Fourth feature of the steering apparatus of the present invention is, in the constitution according to the second feature described above, that a linkage point of a transmission line from the intermediate linkage rod to the rudder is provided with the position thereof being adjustable, at a midpoint between the linkage point of the transmission line from the steering wheel and the linkage point of the transmission line from the assisting force supplying means to the intermediate linkage rod.

According to the fourth feature, in addition to the operation and effect of the second feature described above, such an advantage can be obtained as the manual force and the assisting force can be applied to an output point (linkage point) located at a midpoint from both side in a well-balanced manner, since the linkage points of the three transmission lines connected to the linkage rod are disposed in such an arrangement as the linkage point that receives the force from the intermediate linkage rod (the linkage point of the transmission line from the intermediate linkage rod to the rudder) is located at a midpoint while the two linkage points that apply the force to the intermediate linkage rod (the linkage point of the transmission line from the steering wheel to the intermediate linkage rod and the linkage point of the transmission line from the assisting force supplying means to the intermediate linkage rod) are disposed on both sides of the former.

By locating the linkage point that receives the force from the intermediate linkage rod (the linkage point of the transmission line from the intermediate linkage rod to the rudder) at a midpoint between the other two linkage points with the position being adjustable, it is made possible to adjust the proportions of the manual force and the assisting force in the total force required to move the rudder and change the response of the rudder to the operation of the steering wheel. That is, when the intermediate linkage point is located exactly at the center between the other two linkage points, the manual force and the assisting force each may be one half the total force required to move the rudder. The nearer the intermediate linkage point to the linkage point where the manual force is applied, the higher proportion of the total force required to move the rudder the manual force must supply, although response of the rudder can be quicker to the operation of the steering wheel by the operator. When the intermediate linkage point is located far from the linkage point where the manual force is applied, on the other hand, manual force may supply a smaller portion of the total force required.

Thus the response of the rudder to the operation of the steering wheel and the required magnitude of the manual force can be adjusted by controlling the position of the linkage point that receives the force transmitted from the intermediate linkage rod.

Fifth feature of the steering apparatus of the present invention is, in the constitution according to the second feature described above, that the assisting force supplying means includes at least a motor, a speed reducer and a mechanism which transforms the rotary motion of the motor into reciprocal motion.

According to the fifth feature, in addition to the operation and effect of the second feature described above, the rotating speed of the motor of the assisting force supplying means is reduced by the speed reducer, and transformed from rotary motion into reciprocal motion which is used as the assisting force. The assisting force is applied in the form of reciprocal motion of the transmission line to the intermediate linkage rod. The mechanism which transforms the rotary motion of the motor into reciprocal motion may be, for example, a mechanism that combines a rack and a pinion.

Sixth feature of the steering apparatus of the present invention is, in the constitution according to the second to the fifth feature described above, that control of the assisting force supplying means by the control means is feedback control which includes proportional operation of controlling the magnitude of the assisting force in proportion to the magnitude of deviation.

According to the sixth feature, to say qualitatively, magnitude of the deviation increases as the difference between the manual force applied by the operator and the assisting force supplied from the assisting force supplying means increases. Accordingly, controlling the magnitude of the assisting force in proportion to the magnitude of deviation means increasing the assisting force the difference between the manual force applied by the operator and the assisting force is larger. As the assisting force is increased, manual force required of the operator is reduced and the gap between the amount of operation of the steering wheel by the operator (control quantity) and the amount of motion of the rudder can be decreased more quickly.

Seventh feature of the steering apparatus of the present invention is, in the constitution according to the sixth feature described above, that control of the assisting force supplying means by the control means is feedback control which includes integrating operation that integrates the deviation and adds the result thereof in addition to the proportional operation.

According to the seventh feature, steady state deviation which can occur in the case of applying the proportional control only according to the sixth feature can be eliminated. That is, in case only the proportional control is applied, steady state deviation may arise. For example, when there remains a small deviation at a time when the operation of the steering wheel is stopped, applying an assisting force corresponding to the small deviation may not be able to move the rudder overcoming the resistance thereof. When steady state deviation arises, operation of the steering wheel later may encounter such a problem as there is a deviation in the positional relation between the steering wheel and the rudder in the initial state.

The occurrence of the steady state deviation can be surely eliminated by adding the integrating operation, that integrates the deviation and adds the result thereof, to the proportional operation.

Eighth feature of the steering apparatus of the present invention is, in the constitution according to the seventh feature described above, that control of the assisting force supplying means by the control means is feedback control which includes derivative operation that differentiates the deviation and adds the result thereof in addition to the proportional operation and the integrating operation.

According to the eighth feature, in addition to the operation and effect of the seventh feature described above, an assisting force that satisfactorily follows the deviation can be provided even when the deviation experiences large variations.

BRIEF DESCRIPTION OF THE DRAWINGS

FIGS. 1 through 3 show first embodiment of the present invention, FIG. 1 being a schematic diagram showing the steering apparatus being installed in a vessel, FIG. 2 showing the constitution of the steering apparatus with (A) being an overview, (B) being a side view of a portion near a direction of motion transforming mechanism, and FIG. 3 is a detailed view of a portion near an intermediate linkage rod, where (A) being a plan view and (B) being a sectional view taken along lines A—A of (A).

FIG. 4 schematically shows the mechanism of the steering apparatus according to the present invention.

FIGS. 5 and 6 show second embodiment of the present invention, FIG. 5 being a schematic diagram showing the steering apparatus being installed in a vessel, and FIG. 6 shows the constitution of the steering apparatus, where (A) being an overview and (B) being a side view of a portion near a direction of motion transforming mechanism.

FIGS. 7 and 8 show third embodiment of the present invention, FIG. 7 being a schematic diagram showing the steering apparatus being installed in a vessel, and FIG. 8 showing the constitution of the steering apparatus, where (A) being an overview and (B) being a side view of a portion near a direction motion transforming mechanism.

BEST MODE FOR CARRYING OUT THE INVENTION

Figure 1:
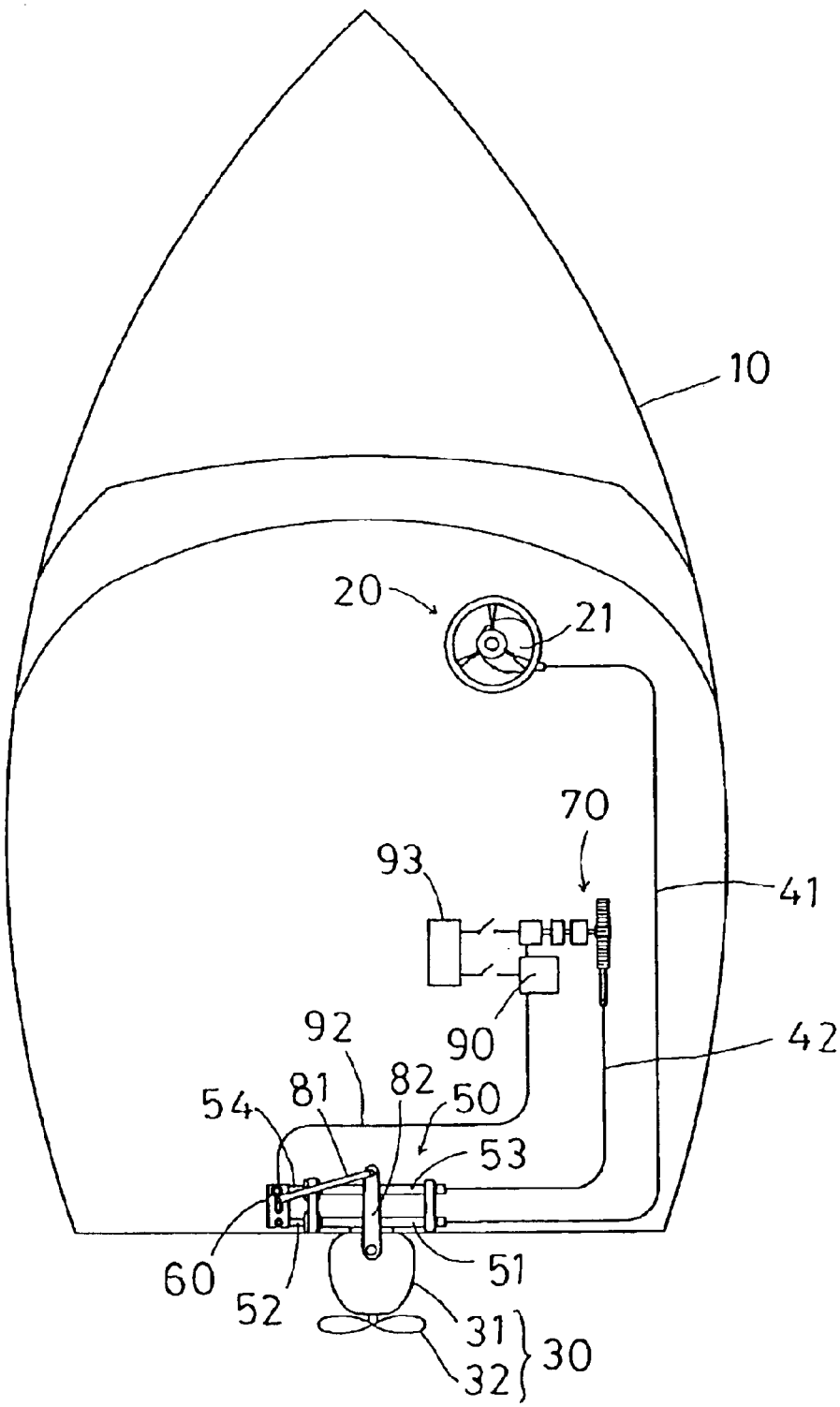
FIGS. 1 through 8 show preferable examples of the steering apparatus according to the present invention.

An example of preferred steering apparatus according to the present invention will be described below with reference to FIGS. 1 through 3.

A steering wheel 20 of a steering apparatus is installed in a control section of a vessel 10, and a rudder 30 which also serves as a power unit is installed at the stern of the vessel 10. A steering cable 41 extends from the steering wheel 20 and is connected to a rod 52 which moves back and forth in a guide 51 of a guide mechanism 50. The rod 52 is connected to an intermediate linkage rod 60. The steering cable 41 and the rod 52 constitute a transmission line L1 which connects the steering wheel 20 and the intermediate linkage rod 60.

Assisting force supplying means 70 is provided to supplement the manual force required of the operator to operate the steering wheel 20. A transmission cable 42 which transmits the assisting force is drawn from the assisting force supplying means 70, and is connected to a rod 54 which moves back and forth in another guide 53 of the guide mechanism 50. The rod 54 is connected to the intermediate linkage rod 60. The transmission cable 42 and the rod 54 constitute a transmission line L2 which connects the assisting force supplying means 70 and the intermediate linkage rod 60.

The steering motion is transmitted from the intermediate linkage rod 60 via a connecting rod 81 and a rudder lever 82 to the ruder 30. The connecting rod 81 and the rudder lever 82 constitute a transmission line L3 which connects the intermediate linkage rod 60 and the rudder 30.

Reference numeral 90 denotes a controller.

The steering wheel 20 is provided with a direction of motion transforming mechanism 21 which transforms rotary motion into reciprocal motion. The direction of motion transforming mechanism 21 may be a mechanism consisting of a rack and a pinion. In such a mechanism as rotation of the steering wheel 20 is transmitted via the pinion to the rack, the rack makes reciprocal motion with a distance, a direction and a speed that correspond to the angle, the direction and the speed of the rotary motion of the steering wheel 20. Connection of the steering cable 41 to the rack causes the reciprocal motion of the rack to be transmitted to the steering cable 41. That is, rotating motion of the steering wheel 20 caused by the operator is transformed into reciprocal motion by the direction of motion transforming mechanism 21 and is transmitted as a reciprocal motion to the transmission line L1 that consists of the steering cable 41 and the rod 52.

The rudder 30 in this example, as mentioned previously, is constituted from an outboard engine that consists of an engine 31 and a screw 32, whole of which constitute the rudder 30 so that the steering direction is controlled by the swiveling motion of the rudder lever 82.

The guide mechanism 50 in this example has such a constitution as two guides 51 and 53 are disposed in parallel to each other by means of the frame 55, and the rods 52 and 54 are disposed movably back and forth by means of the guides 51 and 53, respectively.

The intermediate linkage rod 60 is a linkage rod that relays the control quantities related to the steering force and the position. Specifically, the intermediate linkage rod 60 receives the control quantities related to the manual force and the position transmitted by the transmission line L1 (the steering cable 41 and the rod 52), and the control quantities related to the assisting force and the position transmitted by the transmission line L2 (the transmission cable 42 and the rod 54), and transmits the sum of the manual steering force and the assisting force and the steering position to the transmission line L3 (the connecting rod 81 and the rudder lever 82) provided on the rudder 30 side.

The rod 52 of the transmission line L1 is connected to the intermediate linkage rod 60 by passing a first fixed shaft 61 of the intermediate linkage rod 60 therethrough at a position near the distal end thereof. This enables the rod 52 and the intermediate linkage rod 60 to freely swivel with respect to each other around the first fixed shaft 61.

The rod 54 of the transmission line L2 is similarly connected to the intermediate linkage rod 60 by passing a second fixed shaft 62 of the intermediate linkage rod 60 therethrough at a position near the distal end thereof. This enables the rod 54 and the intermediate linkage rod 60 to freely swivel with respect to each other around the second fixed shaft 62.

As a result, in case the rod 54 of the transmission line L2 does not move and only the rod 52 of the transmission line L1 moves, for example, the intermediate linkage rod 60 rotates by an angle that corresponds to the distance traveled around the second fixed shaft 62 like a hand of a clock, thus resulting in a deviation from the initial state.

The connecting rod 81 that constitutes the transmission line L3 is connected to the intermediate linkage rod 60. A linkage point P3 on the intermediate linkage rod 60 to which the connecting rod 81 is connected is located at the midpoint between a linkage point P1 on the intermediate linkage rod 60 where the rod 52 of the transmission line L1 is connected, and a linkage point P2 on the intermediate linkage rod 60 where the rod 54 of the transmission line L2 is connected. Specifically, the connecting rod 81 is installed by inserting an inserted portion 81*a*, which suspends from the connecting rod at a position near the base thereof, into one of a plurality of fitting holes 63 provided in the intermediate linkage rod 60 so as to be capable of freely swiveling, and is prevented from coming off. Thus the linkage point P3 of the transmission line L3 is located at the midpoint between the linkage point P1 of the transmission line L1 and the linkage point P2 of the transmission line L2.

In this constitution, when the intermediate linkage rod 60 is moved by the rods 52, 54, the connecting rod 81 moves to follow the motion of the intermediate linkage rod 60. This swivels the rudder lever 82 which is connected to the connecting rod 81, so that the rudder 30 is caused to swivel by the swiveling motion of the rudder lever 82.

Since the fitting holes 63 to which the connecting rod 81 is connected are provided in plurality, the linkage point P3 of the connecting rod 81 can be adjusted from a position near the linkage point P1 to a position far therefrom. While four fitting holes 63 are provided in FIG. 3, the present invention is not limited to this constitution and any number of the fitting holes may be provided.

The assisting force supplying means 70 comprises a motor 71, a speed reducer 72, a clutch 73 and the direction of motion transforming mechanism 74 which transforms the rotary motion of the motor 71 into reciprocal motion.

The motor 71 may be a dc motor, but is not limited to dc motor as long as the rotating speed can be conveniently controlled.

The direction of motion transforming mechanism 74 in this example is constituted from a rack 74*a* and a pinion 74*b*. The transmission cable 42 is connected to a connecting rod 75 which is fixed on the rack 74*a*. The direction of motion transforming mechanism 74 is not limited to the combination of the rack 74*a* and the pinion 74*b*, as long as it is capable of transforming the rotary motion of the motor 71 into reciprocal motion.

As the motor 71 rotates, rotating motion thereof is transmitted by the speed reducer 72 and the clutch 73, and is transformed into reciprocal motion by the direction of motion transforming mechanism 74. As a result, the rotary motion of the motor 71 for assisting the steering force is transformed into reciprocal motion of the transmission cable 42 which exerts reciprocal assisting force. The assisting force moves the intermediate linkage rod 60 via the transmission line L2 consisting of the transmission cable 42 and the rod 54.

Although the clutch 73 is not inevitable, the assisting force from the motor 71 can be freely connected and disconnected by providing the clutch. By operating the clutch, the operator can switch between steering by manual force only and steering assisted by the assisting force supplying means 70, as required.

A controller 90 is means for controlling the assisting force supplying means 70. The controller 90 controls the rotation of the motor 71 such as dc motor thereby supplying desired assisting force. More specifically, the controller 90 receives the deviation between two linkage points P1 and P2, which is detected by a deviation detector 91 (refer to FIG. 3) and is input via a signal line 92, and controls the direction and speed of rotation of the motor 71 by the control quantities corresponding to the deviation.

The deviation detector 91 detects the deviation between the two linkage points P1 and P2 caused by a change from the initial state of the positional relation between the two linkage points P1 and P2 of the intermediate linkage rod 60. The deviation detector 91 in this example comprises an angular deviation detector that detects angular deviation between the two linkage points P1 and P2. As shown in FIG. 3, the deviation detector 91 is mounted on the second fixed shaft 62 so as to detect the angle of rotation of the second fixed shaft 62 from the initial state thereof.

Reference numeral 93 denotes a battery. The battery 93 supplies electric power to the controller 90 and the motor 71. The battery 93 is a rechargeable battery which is charged when the engine 31 of the outboard engine is running, but is not limited to this.

Supply of electric power from the battery 93 to the motor 71 and the controller 90 is turned on by automatic switches 94, 95 which turn on when the engine 31 of the outboard engine is started, and turned off by automatic switches 94, 95 which turn off when the engine 31 of the outboard engine is stopped. It needs not to say that power to the controller 90 may be turned on earlier than the power to the motor 71, and turned off later than the power to the motor 71.

A manual switch not shown in the drawing which is interlocked with the clutch 73 may also be installed in the power supply line from the battery 93. Installing the manual switch enables it to turn off also the power to the assisting force supplying means when the vessel is steered only with manual force without using the assisting force supplying means.

Now making reference to FIG. 4, mechanism and operating principle of the steering apparatus will be described in more detail.

Figure 4:
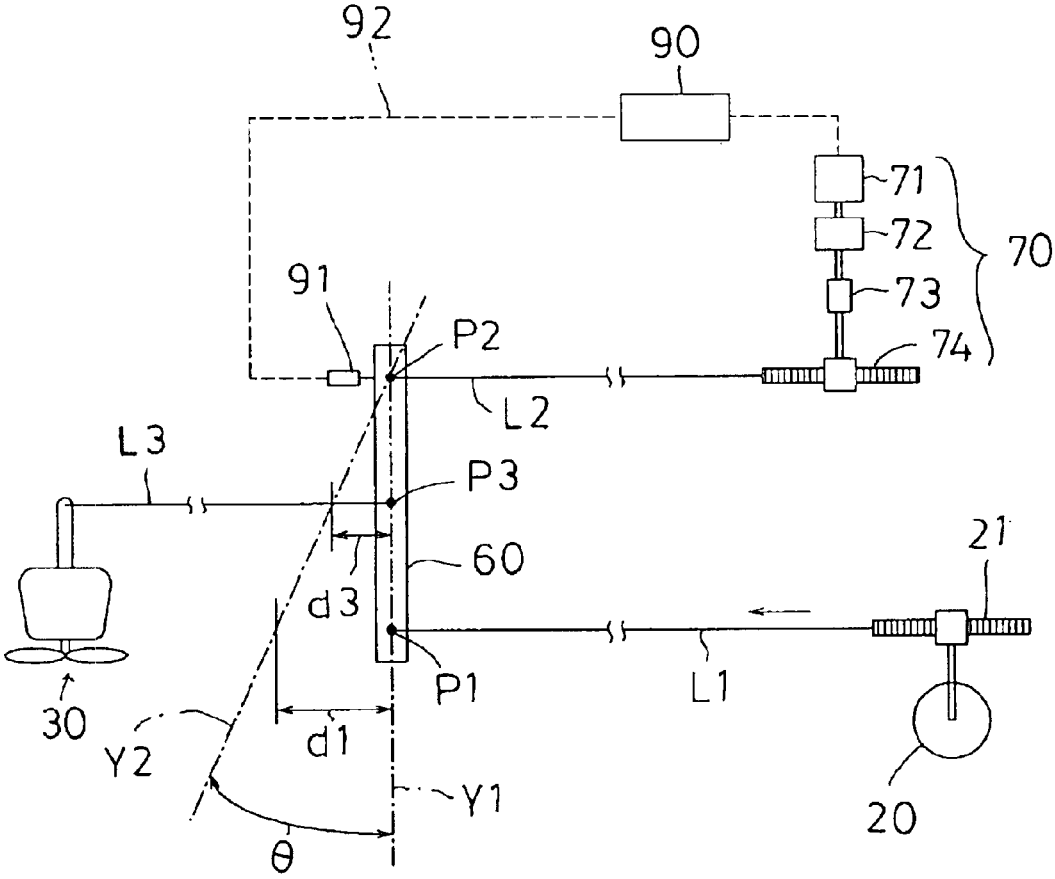

Position of the intermediate linkage rod 60 shown with solid line in FIG. 4, where the three linkage points P1, P2 and P3 provided on the intermediate linkage rod 60 lie on a vertical line Y1 in the drawing, is referred to as the initial state. As the operator starts to operate the steering wheel 20 in the initial state, the transmission line L1 comprising the steering cable 41 and other is moved back or forth (advancing in the direction of arrow in the drawing) via the direction of motion transforming mechanism 21 as the steering wheel 20 is turned. This causes the linkage point P1 of the intermediate linkage rod 60 to move back or forth by a distance d1 that corresponds to the movement of the transmission line. Since the assisting force of the assisting force supplying means 70 is not applied to the linkage point P2 at this time, the linkage point P2 of the transmission line L2 from the assisting force supplying means 70 does not move. As a result, a deviation is generated between the linkage point P1 and the linkage point P2. This deviation can be detected, for example, as an angular deviation θ. At this time, the intermediate linkage rod 60 is positioned on an oblique line indicated with Y2, while the linkage point P1 moves by a distance d1 and accordingly the linkage point P3 of the transmission line L3 on the rudder 30 side moves by a distance d3 (d1>d3), thereby to move the ruder 30. The linkage point P2 remains at the original position.

When the intermediate linkage rod 60 is moved by an angular deviation θ by the operation of the steering wheel 20, the angular deviation θ is detected by the deviation detector 91 which sends the information on the angular deviation θ via the signal line 92 to the controller 90. The controller 90 which has received the information on the angular deviation θ starts the motor 71 of the assisting force supplying means 70 so as to generate an assisting force in such a direction that cancels out the deviation. The assisting force is transmitted via the speed reducer 72, the clutch 73 and the direction of motion transforming mechanism 74 to the transmission line L2 as a force to push along a straight line, and pushes the intermediate linkage rod 60 via the linkage point P2 in the same direction as the manual force. That is, the assisting force from the assisting force supplying means 70 is added to the manual force exerted by the operator so that the resultant force is transmitted via the linkage point P3 to the transmission line L3 thereby to move the rudder 30. In other words, once the assisting force is applied in response to the deviation being generated, the operator can steer the vessel by turning the steering wheel 20 only by a force equivalent to the force required to steer the rudder 30 minus the assisting force, so that the operator can operate the steering wheel 20 with a force which is reduced by the assisting force applied.

Control of the assisting force supplying means 70 by the controller 90 may be feedback control which makes the assisting force proportional to the deviation represented by the angular deviation θ. When the deviation increases, the assisting force is controlled to increase in proportion thereto. A larger deviation typically means that the assisting force from the assisting force supplying means 70 is small compared to the manual force applied to the intermediate linkage rod 60 by the operator, and is insufficient. Therefore, increasing the assisting force in proportion to the deviation means applying larger assisting force as a larger force is required to be exerted by the operator to operate the steering wheel, and quickly relieving the operator of the burden of manual operation.

In the proportional feedback control, since the assisting force is applied as long as there is a deviation, application of the assisting force continues until the deviation becomes zero, namely till the linkage points P1, P2 and P3 on the intermediate linkage rod 60 return to the initial state of lying on the vertical line Y1 in the drawing.

That the linkage points return to the initial state after the operator operated the steering wheel 20 means that there is no gap between the control quantity of steering the steering wheel 20 by the operator and the amount of motion of the rudder 30.

In the case of the proportional feedback control, there may be a case where the angular deviation θ remains at the end. In this case, there arises a gap amounting to a distance of d1−d3 in the reciprocal motion of the transmission line L1 from the steering wheel 20, namely in the reciprocal motion of the transmission line L3 to the rudder 30 for the amount of controlling the rudder 30.

The deviation that remains at the end is a steady state deviation, which may occur when the feedback control is based on proportional operation only. That is, when the deviation decreases, the force of returning the deviation of the intermediate linkage rod 60 to zero also decreases and, as a result, the steady state deviation is generated when the force cannot overcome the resistance of the rudder 30.

In order to eliminate the steady state deviation, integrating operation of integrating the deviation and added the result may be added to the proportional control. By applying the proportional plus integral control (PI control) so as to eliminate the steady state deviation, the possibility that the gap arises between the control quantity of steering the steering wheel 20 by the operator and the amount of motion of the rudder 30 can be surely eliminated.

Proportional plus integral plus derivative control (PID control) may also be employed by adding differentiation to the PI control.

Figure 3:
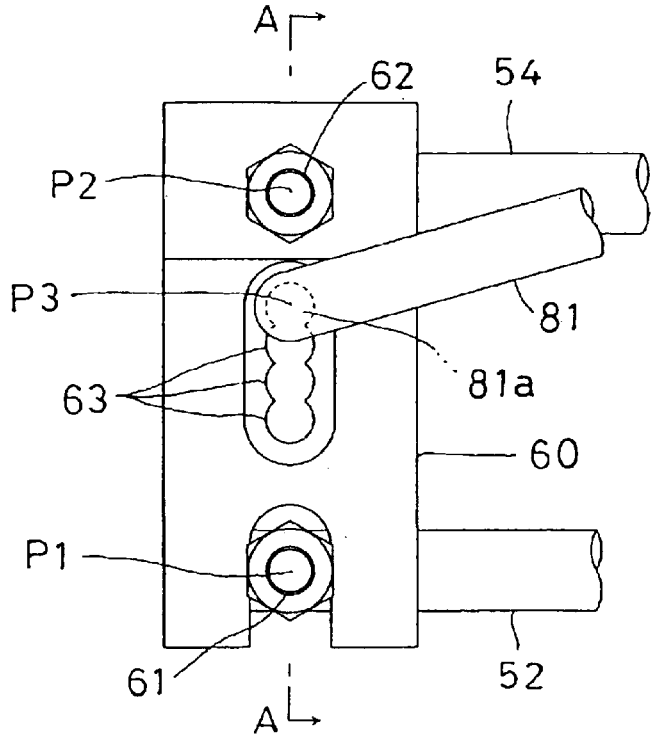
Figure 3:
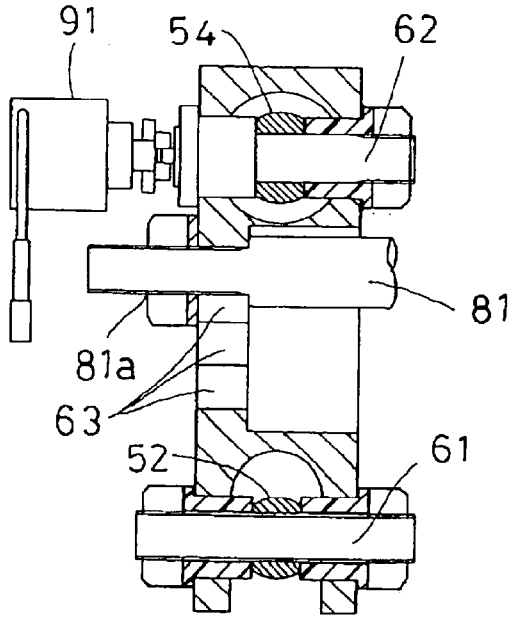

Position of the linkage point P3 located at the midpoint can be adjusted by means of the fitting holes 63 (refer to FIG. 3).

When the linkage point P3 is located at the center of the linkage point P1 and the linkage point P2, balance of the moment of rotation around the linkage point P3 dictates that the distance between the linkage points P3 and P1 and the distance between the linkage points P3 and P2 are equal. Therefore, the assisting force and the manual force may each be one half the force required to move the rudder 30. That is, the operator can steer the rudder 30 with a force one half that required to move it. This enables it to move the intermediate linkage rod 60 in a stable condition.

When the linkage point P3 is brought near the linkage point P2, the assisting force increases so that the manual force required of the operator decreases accordingly.

When the linkage point P3 is brought near the linkage point P1, on the other hand, the assisting force decreases so that the amount of manual force which is saved from the operator decreases accordingly. But in return for this disadvantage, gap (d1−d3) of the amount of motion of the rudder 30 (precisely, the amount of reciprocal motion of the transmission line L3) for the control quantity of operating the steering wheel 20 (precisely, the amount of reciprocal motion of the transmission line L1) by the operator decreases, and good characteristic of the rudder 30 to follow the operation of the steering wheel 20 can be maintained.

While the deviation of the intermediate linkage rod 60 is detected as the angular deviation θ in this example, the deviation may also be detected in other forms such as the difference between distances traveled by the transmission lines L1 and L2 from the initial state. When the angular deviation θ is detected, the deviation can be detected precisely and relatively easily by using a potentiometer or the like.

Another example of preferable steering apparatus according to the present invention will be described below with reference to FIG. 5 and FIG. 6.

Figure 2:
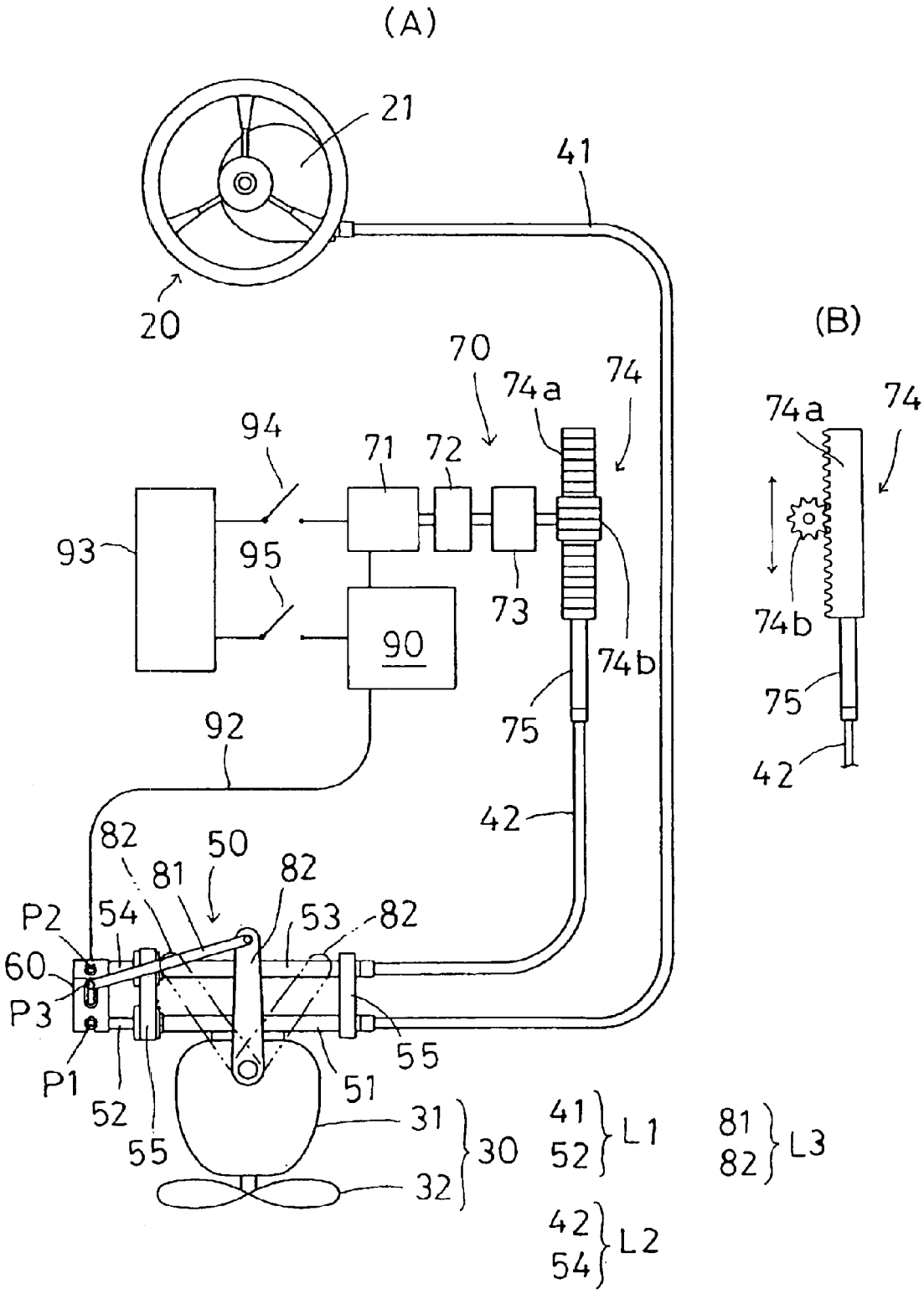

In the constitution shown in FIGS. 1 through 3, the intermediate linkage rod 60 is located at a position near the rudder 30, and assisting force is transmitted to the intermediate linkage rod 60 by extending the transmission cable 42 from the assisting force supplying means 70. In the constitution shown in FIGS. 5 and 6, in contrast, the intermediate linkage rod 160 is located in the vicinity of the assisting force supplying means 170, and the transmission cable 42 is omitted. Instead, a steering cable 143 is installed on the rudder 130 side from the intermediate linkage rod 160.

Throughout the present application including other embodiments, positions of the steering wheel and the rudder are located at specified positions such that the steering wheel is installed in the control section near the bow and the rudder is installed at the stern of the vessel. Other components such as the intermediate linkage rod and the assisting force supplying means may be located as required by the design, such as near the steering wheel, near the rudder or at a midpoint between the steering wheel and the rudder.

In this example, a steering cable 141 is installed from the steering wheel 120 to the intermediate linkage rod 160, a steering cable 143 is installed from the intermediate linkage rod 160 to the rudder 130, and the assisting force supplying means 170 is installed midway between the steering wheel 120 and the rudder 130.

The steering wheel 120 is installed in the control section of the vessel 110, and a direction of motion transforming mechanism 121 is installed to accompany the steering wheel 120. These components have the same mechanisms as those of the steering wheel 20 and the direction of motion transforming mechanism 21 described previously. The rudder 130 constituted from an outboard engine which consists of an engine 131 and a screw 132 is installed at the stern of the vessel 110. These components have the same mechanisms as those of the rudder 30, the engine 31 and the screw 32 described previously.

The steering cable 141 is installed from the steering wheel 120 side and is connected to a rod 152 which passes through a guide 151, while the rod 152 is connected to the intermediate linkage rod 160. This connection is made similarly to that of the example described previously. The steering cable 141 and the rod 152 constitute the transmission line L1. The point where the transmission line L1 is connected to the intermediate linkage rod 160 is denoted as P1 similarly to the previous example.

The assisting force supplying means 170 comprises a motor 171, a speed reducer 172, a clutch 173 and a direction of motion transforming mechanism 174, while the direction of motion transforming mechanism 174 comprises a rack 174*a* and a pinion 174*b*, the rack 174*a* having a connecting rod 175 fixed thereto. These mechanisms are similar to those of the assisting force supplying means 70 described previously.

In this example, the connecting rod 175 constitutes the transmission line L2 from the assisting force supplying means 170 to the intermediate linkage rod 160. The transmission cable 42 of the previous example is omitted in the case of this transmission line L2. The point where the transmission line L2 is connected to the intermediate linkage rod 160 is denoted as P2 similarly to the previous example. A deviation detector 191 which detects the angular deviation θ is installed on the shaft of the linkage point P2. The deviation detector 191 can be mounted similarly to the case of the deviation detector 91 described previously.

The steering cable 143 is installed from the intermediate linkage rod 160 to the rudder 130, and is connected to a rod 157 which is passed through a fixed guide 156. The rod 157 is connected to a connecting rod 181 which is in turn connected to a rudder lever 182. The steering cable 143, the rod 157, the connecting rod 181 and the rudder lever 182 constitute the transmission line L3 from the intermediate linkage rod 160 to the rudder 130. The point where the transmission line L3 (actually the steering cable 143) is connected to the intermediate linkage rod 160 is denoted as P3 similarly to the previous example. Position of the linkage point P3 can be adjusted.

Reference numeral 190 denotes a controller, 192 denotes a signal line from the deviation detector 191, 193 denotes a battery and 194 and 195 are automatic switches. These components are the same as the controller 90, the signal line 92, the battery 93 and the automatic switches 94, 95 of the example described previously.

Steering operation in this example having the constitution described above is basically similar to that described with reference to FIG. 4. As the operator operates the steering wheel 120, rotation of the steering wheel 120 is transformed into reciprocal motion by the direction of motion transforming mechanism 121, and is transmitted as reciprocal motion of the transmission line L1. The reciprocal motion is added to the intermediate linkage rod 160 via the linkage point P1. That is, manual force of the operator exerted on the steering wheel 120 is added to the intermediate linkage rod 160 via the linkage point P1. This causes the intermediate linkage rod 160 to swivel around the linkage point P2, thus generating an angular deviation θ. The angular deviation θ is detected by the deviation detector 191 and is input to the controller 190 via the signal line 192. The controller 190 which has received the deviation controls the motor 171 of the assisting force supplying means 170 to rotate at a speed proportional to the magnitude of deviation. Rotation of the motor 171 is transmitted via the speed reducer 172, the clutch 173 and the direction of motion transforming mechanism 174 to the transmission line L2 (connecting rod 175), so that the transmission line L2 makes reciprocal motion in the same direction as the transmission line L1. As a result, the manual force of the operator exerted on the steering wheel 120 and the assisting force from the assisting force supplying means 170 are added at the linkage point P2, and the resultant force causes reciprocal motion of the intermediate linkage rod 160. The reciprocal motion of the intermediate linkage rod 160 is transmitted via the linkage point P3 to the transmission line L3 (steering cable 143) thereby to cause reciprocal motion of the transmission line L3. The reciprocal motion of the transmission line L3 moves the rudder 130 via the connecting rod 181 and the rudder lever 182.

As the assisting force is added, the operator can steer the vessel by turning the steering wheel 120 only by a force equivalent to the force required to steer the rudder 130 minus the assisting force, so that the operator can operate the steering wheel 120 with a force which is smaller by the assisting force applied.

Moving direction of the rudder 130 is determined by the rotating direction of the steering wheel 120, and the amount of motion of the rudder 130 is determined by the control quantity of rotating the steering wheel 120.

While the controller 190 controls the assisting force so as to act to cancel the deviation, magnitude of the assisting force may be either constant as in the example described previously, or may be controlled to be proportional to the deviation in feedback control. Moreover, feedback control based on PI control may also be employed by adding integrated deviation term to the proportional term. Proportional plus integral plus derivative control (PID control) may also be employed by adding differentiation to the PI control.

It needs not to say that the proportion of the assisting force to the manual force can be increased by bringing the linkage point P3 nearer to the linkage point P2. Response characteristic of the rudder 130 to the operation of the steering wheel 120 can be improved by bringing the linkage point P3 nearer to the linkage point P1.

Figure 7:
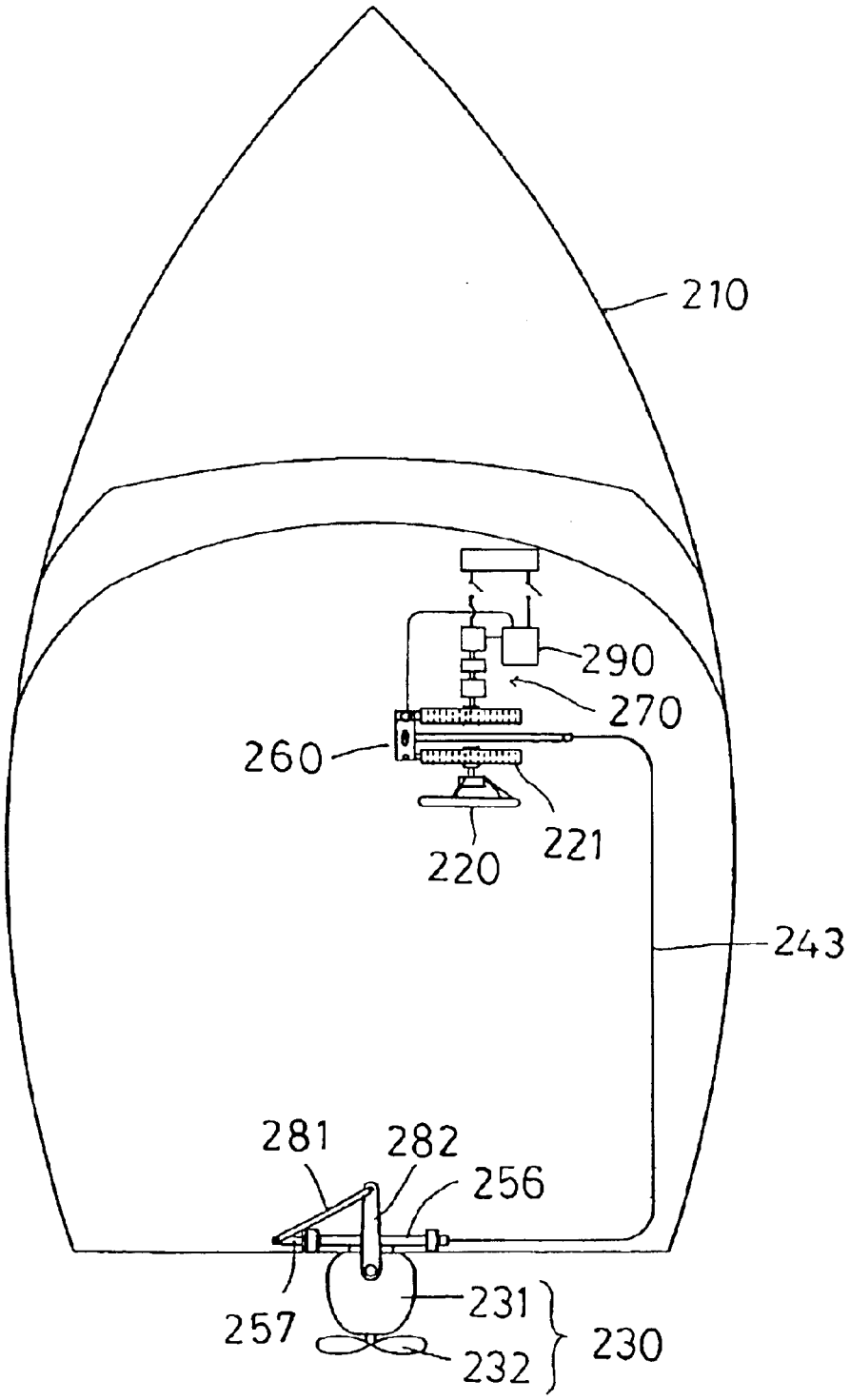
Figure 8:
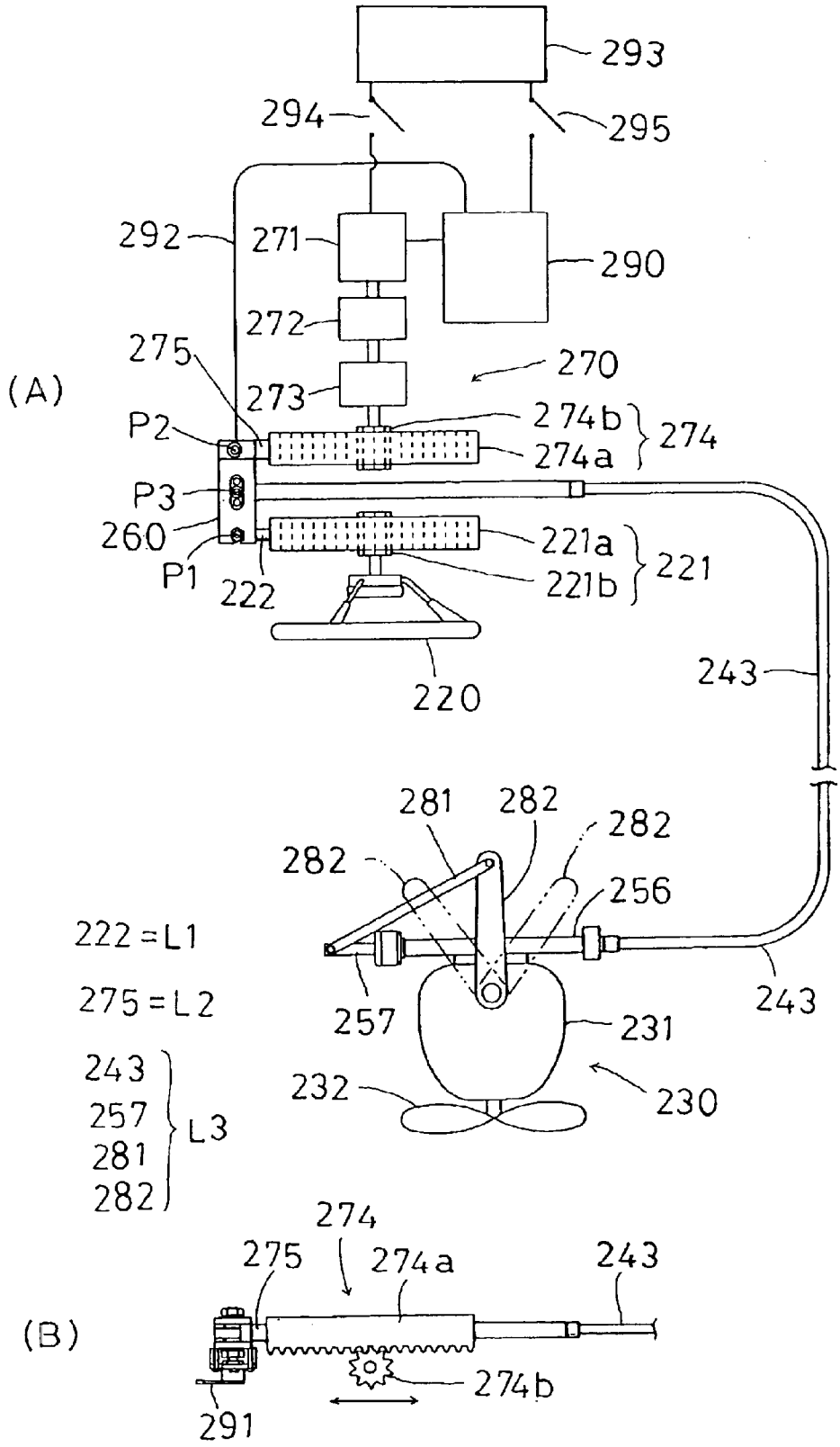
Figure 9:
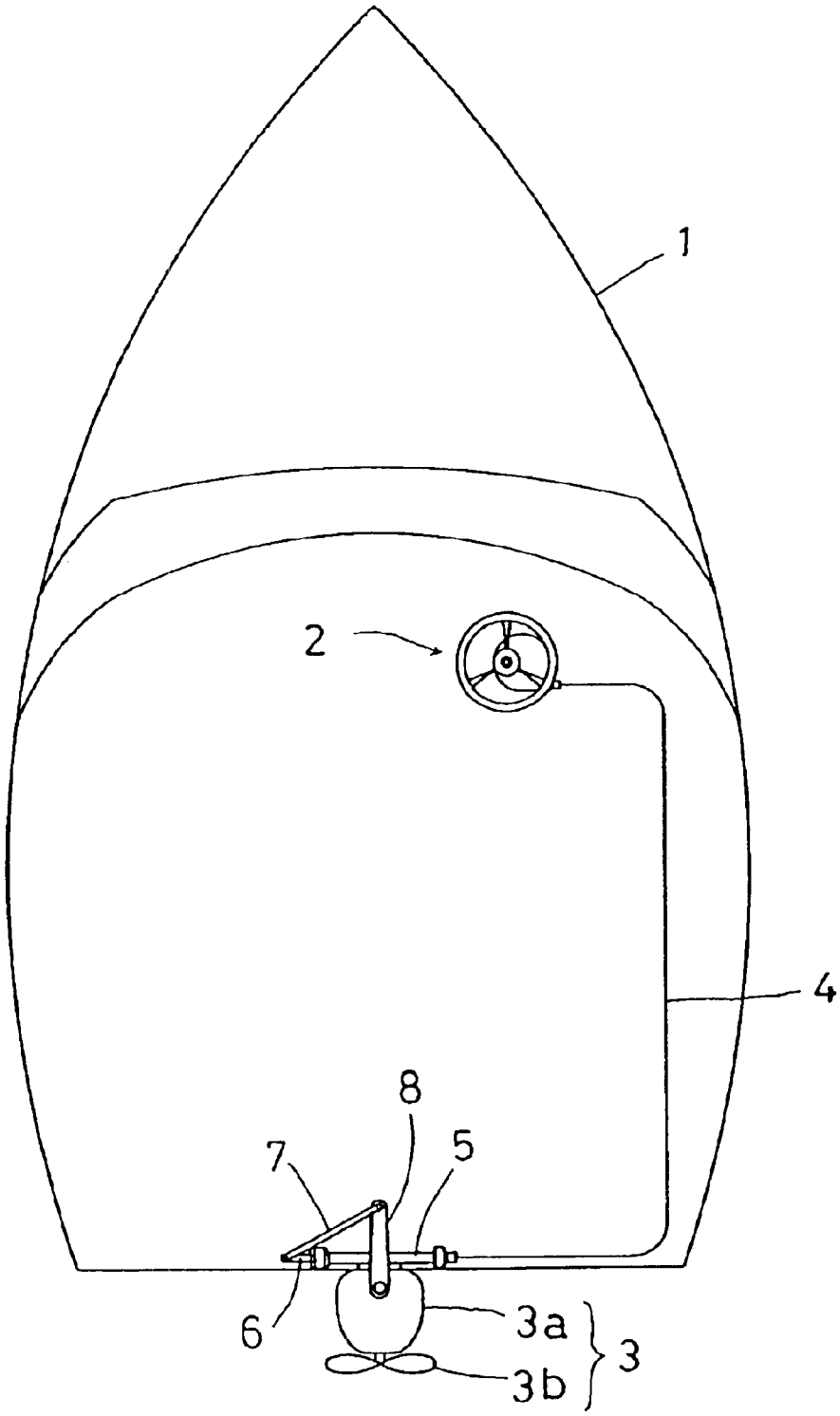
FIG. 9 schematically shows an example of the manual steering apparatus of the prior art.

A further another example of preferred steering apparatus according to the present invention will be described below with reference to FIG. 7 and FIG. 8.

In this example, an intermediate linkage rod 260 and an assisting force supplying means 270 are installed collectively near the control section of the vessel 210 where a steering wheel 220 is installed.

Also in this example, the intermediate linkage rod 260 is connected via a connecting rod 222 to the direction of motion transforming mechanism 221 which is installed to accompany the steering wheel 220. Specifically, the connecting rod 222 constitutes the transmission line L1 described previously with reference to FIG. 4, and the linkage point of the connecting rod 222 and the intermediate linkage rod 260 constitutes the linkage point P1. In this example, the steering cables 41, 141, and the transmission cable 42 in the examples shown in FIG. 1 and FIG. 5 are omitted, while only a steering cable 243 is used.

The direction of motion transforming mechanism 221 comprises a rack 221*a* and a pinion 221*b*, while the connecting rod 222 is fixed onto the rack 221*a*, similarly to the example described previously.

Figure 5:
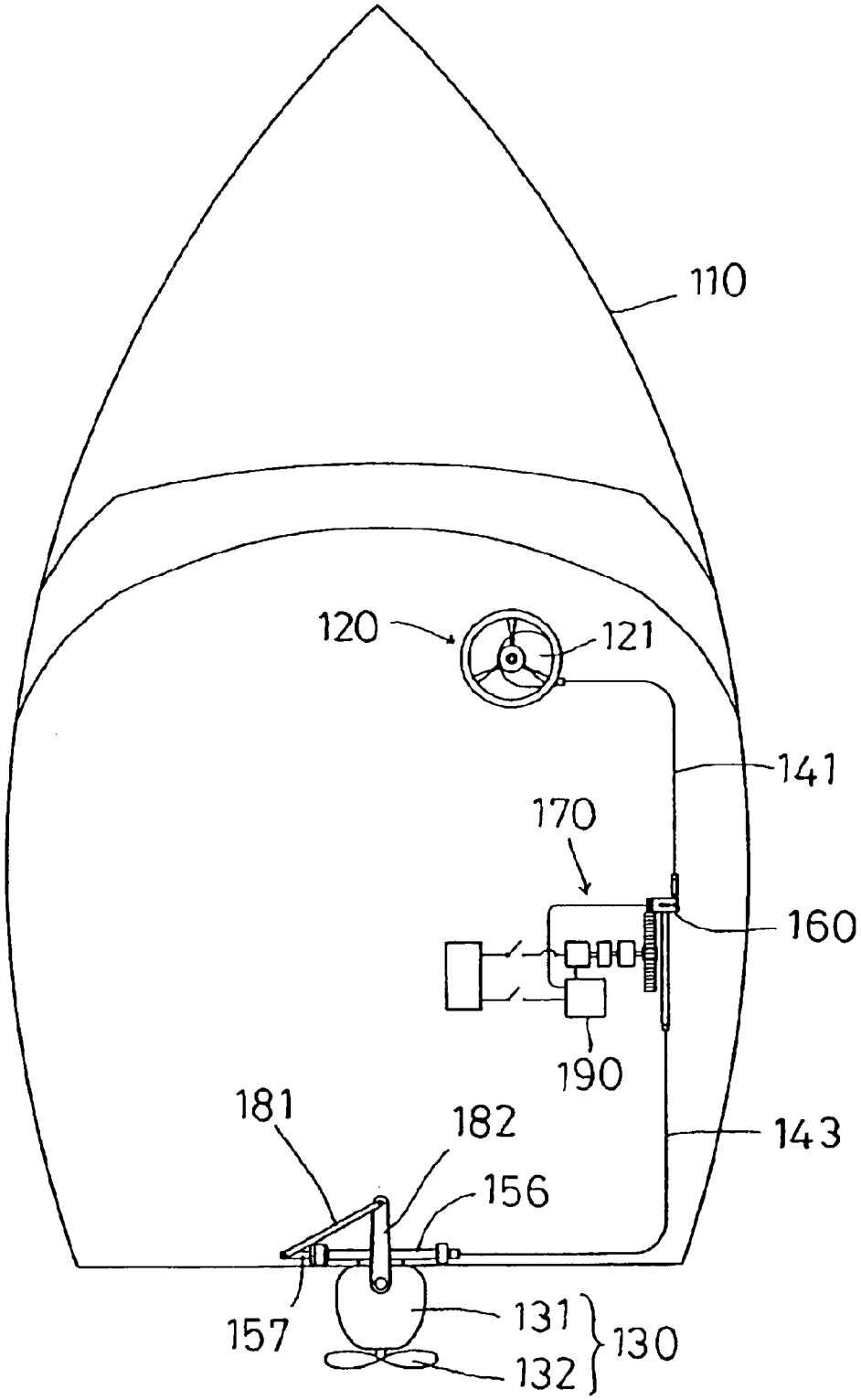
Figure 6:
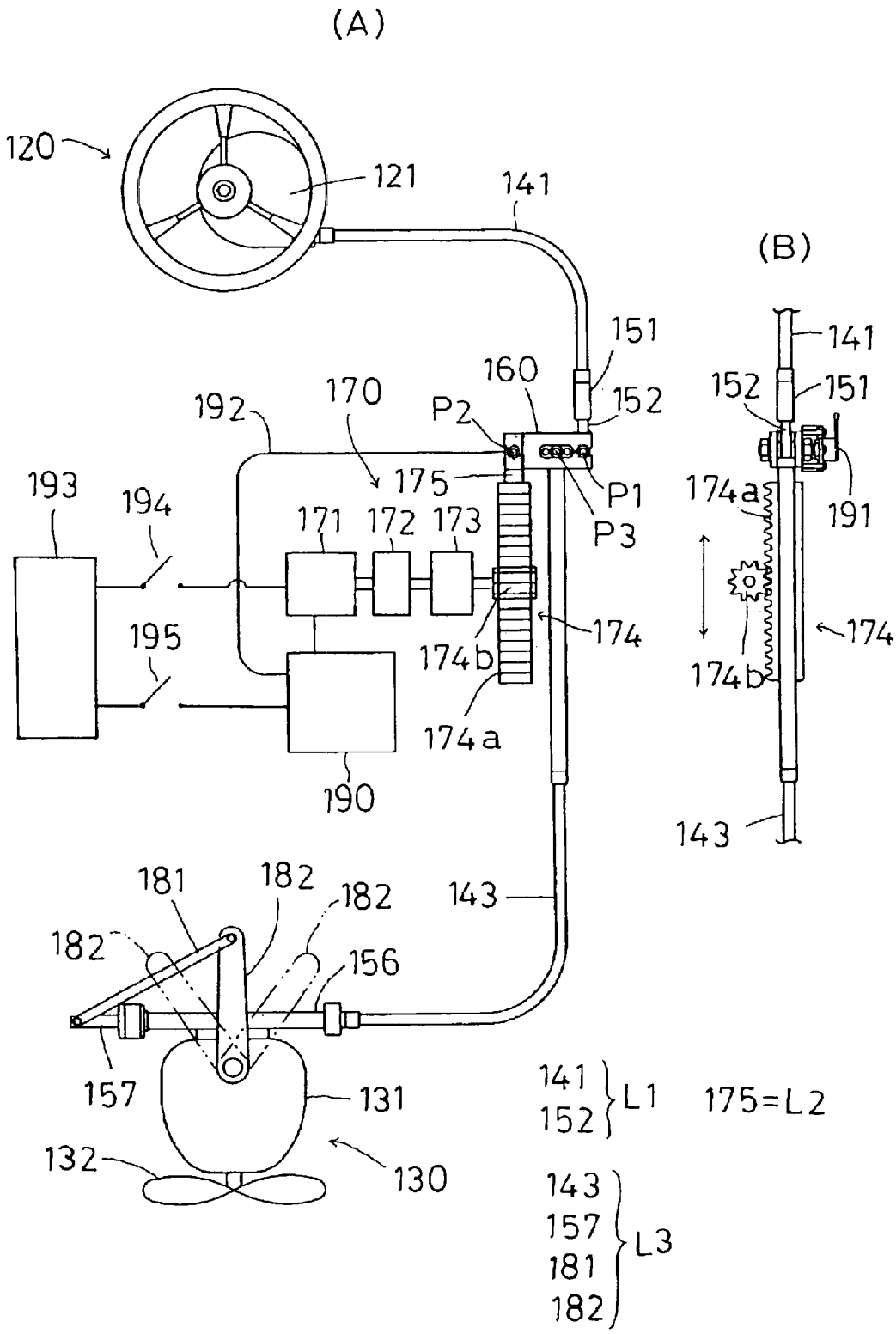

The assisting force supplying means 270 may have the same constitution as that of the example shown in FIG. 5 and FIG. 6, comprising a motor 271, a speed reducer 272, a cutch 273 and a direction of motion transforming mechanism 274. The direction of motion transforming mechanism 274 comprises a rack 274*a* and a pinion 274*b*, while a connecting rod 275 is fixed onto the rack 274*a*. These components have the same mechanisms as those of the assisting force supplying means 170 described previously. In this example, the connecting rod 275 constitutes the transmission line L2 from the assisting force supplying means 270 to the intermediate linkage rod 260, and the linkage point of the connecting rod 275 and the intermediate linkage rod 260 constitutes the linkage point P2. A deviation detector 291 which detects the angular deviation θ is installed on the shaft of the linkage point P2. The deviation detector 291 can be mounted similarly to the case of the deviation detector 91 described previously in FIG. 3.

The steering cable 243 is installed from the intermediate linkage rod 260 to the rudder 230, and is connected to a rod 257 which is passed through a fixed guide 256. The rod 257 is connected to a connecting rod 281 which is in turn connected to a rudder lever 282. The steering cable 243, the rod 257, the connecting rod 281 and the rudder lever 282 constitute the transmission line L3 from the intermediate linkage rod 260 to the rudder 230. The point where the transmission line L3 (actually the steering cable 243) is connected to the intermediate linkage rod 260 is denoted as P3 similarly to the previous example. Position of the linkage point P3 can be adjusted.

Reference numeral 290 denotes a controller, 292 denotes a signal line from the deviation detector 291, 293 denotes a battery and 294, 295 are automatic switches. These components are the same as the controller 90, 190, the signal line 92, 192, the battery 93, 193, and the automatic switches 94, 194, 95, 195 of the examples described previously.

The rudder 230 constituted from an outboard engine which consists of an engine 231 and a screw 232 is installed at the stern of the vessel 210. These components have the same mechanisms as those of the examples described previously.

Steering operation in this example having the constitution described above is basically similar to the examples described previously. As the operator operates the steering wheel 220, rotation of the steering wheel 220 is transformed into reciprocal motion by the direction of motion transforming mechanism 221, and is transmitted as reciprocal motion of the transmission line L1 (the connecting rod 222). The reciprocal motion is applied to the intermediate linkage rod 260 via the linkage point P1. That is, manual force of the operator exerted on the steering wheel 220 is applied to the intermediate linkage rod 260 via the connecting rod 222 and the linkage point P1. This causes the intermediate linkage rod 260 to swivel around the linkage point P2, thus generating an angular deviation θ. The angular deviation θ is detected by the deviation detector 291 and is input to the controller 290 via the signal line 292. The controller 290 which has received the deviation controls the motor 271 of the assisting force supplying means 270 to rotate at a speed proportional to the magnitude of deviation. Rotation of the motor 271 is transmitted via the speed reducer 272, the clutch 273 and the direction of motion transforming mechanism 274 to the transmission line L2 (connecting rod 275), so that the transmission line L2 (connecting rod 275) makes reciprocal motion in the same direction as the transmission line L1. As a result, the manual force of the operator exerted on the steering wheel 220 and the assisting force applied by the assisting force supplying means 270 are added at the linkage point P2, and the resultant force causes reciprocal motion of the intermediate linkage rod 260. The reciprocal motion of the intermediate linkage rod 260 is transmitted via the linkage point P3 to the transmission line L3 (steering cable 243) thereby to cause reciprocal motion of the transmission line L3. The reciprocal motion of the transmission line L3 moves the rudder 230 via the connecting rod 281 and the ruder lever 282.

While the controller 290 controls the assisting force so as to act to cancel the deviation, magnitude of the assisting force may be either constant as in the example described previously, or may be controlled to be proportional to the deviation in feedback control. Moreover, feedback control based on PI control may also be employed by adding integrated deviation to the proportional term. Proportional plus integral plus derivative control (PID control) may also be employed by adding differentiation to the PI control.

In the examples of the present invention described above, the steering wheel 20, 120, 220 is not limited to wheel shape and may be anything that can serve as a handle to steer the vessel. The steering wheel 20, 120, 220 of the present invention is meant to include steering means of various shapes including wheel.

The rudder 30, 130, 230 of the examples of the present invention may not necessarily be constituted from the engine 31, 131, 231 and the screw 32, 132, 232. Of course, shape of the rudder 30, 130, 230 is not limited, and may any shape that can function as a rudder.

The steering cable 41, 141, 143, 243 and the transmission cable 42 in the examples described above may be constituted from wires. The cable is a wire-like material which transmits the direction and amount of rotation of the steering wheel as the direction and amount of reciprocal motion, and is flexible enough to bend. Use of the cable as described above enables it to transmit the motion of the steering wheel easily to the rudder, thereby to constitute the steering mechanism with a low cost. Also because the cable provides a high degree of freedom in installation, connection between the steering wheel and the rudder which are located apart can be made without interfering with the other units.

The intermediate linkage rod 60, 160, 260 in the examples described above receives the manual force from the steering wheel and the assisting force from the assisting force supplying means and the control quantity (the amount of steering), and transmits the resultant force and the control quantity to the rudder, functioning as an intermediate link of a kind of link mechanism. Accordingly, any member that performs this function can be regarded to belong to this category.

In the examples described above, the assisting force supplying means 70, 170, 270 may be any mechanism which provides the assisting force, and the source of the assisting force may not necessarily be a rotary motor but may be one which can apply a reciprocal force to the transmission line L2.

Industrial Applicability

The steering apparatus of the present invention makes it possible to sufficiently reduce the manual force required for operating the so-called wire-operated steering apparatus wherein force and amount of operating the steering wheel are transmitted by the steering cable such as wire to the rudder provided at the stern, that has to be operated only by the manual force of the operator in the prior art. Thus the steering apparatus can be operated by, for example, a weak-powered female operator, thus allowing for wider users to operate pleasure boats. Also because larger steering force can be provided with the same manual force by applying the assisting force, it is made possible to apply the wire-operated steering apparatus of this kind to vessels larger than those to which it can be applied in the prior art.

While hydraulic steering apparatuses have been used in larger vessels, there have been such problems that hydraulic steering apparatuses use oil which may pollute the sea water and results in low energy efficiency. According to the steering apparatus of the present invention, hydraulic apparatuses can be replaced with wire-operated steering apparatuses in some of large vessels which have previously been relying on the hydraulic steering apparatuses. Therefore, the steering apparatus of the present invention can be preferably used as a solution for the problems of environmental conservation and energy efficiency.

What is claimed is:

1. A steering apparatus including a transmission line for transmitting control quantity of steering from a steering wheel (20, 120, 220) to a rudder (30, 130, 230) comprising a steering cable means, for steering the rudder by transmitting the control quantity of operating the steering wheel to the rudder by reciprocal motion of said transmission line, wherein assisting force supplying means (70, 170, 270) is additionally installed for supplementing the manual force required to operate the steering wheel and an intermediate linkage rod (60, 160, 260) is installed to interpose in said transmission line, with the transmission line (L1) from the steering wheel and the transmission line (L3) to said rudder being linked to said intermediate linkage rod and the transmission line (L2) for the assisting force supplied from said assisting force supplying means is connected thereto, so that said intermediate linkage rod is moved back and forth by the sum of the manual force from the steering wheel and the assisting force from the assisting force supplying means, and the control quantity from said steering wheel is transmitted to the rudder, thereby steering the rudder, wherein the linkage point (P1) of the transmission line (L1) from the steering wheel (20, 120, 220) to the intermediate linkage rod (60, 160, 260) and the linkage point (P2) of the transmission line (L2) from the assisting force supplying means (70, 170, 270) are located apart from each other, and control means (90, 190, 290) is provided which, when there arises a deviation from the initial state in the positional relation between these linkage points due to the operation of the steering wheel, directs said assisting force supplying means to supply assisting force in such a direction that cancels said deviation, wherein a linkage point (P3) of a transmission line (L3) from the intermediate linkage rod (60, 160, 260) to the rudder (30, 130, 230) is provided with the position, thereof being adjustable, at a midpoint between the linkage point (P1) of the transmission line (L1) from the steering wheel (20, 120, 220) to the intermediate linkage rod and the linkage point (P2) of the transmission line (L2) from the assisting force supplying means (70, 170, 270) to the intermediate linkage rod.

2. A steering apparatus including a transmission line for transmitting control quantity of steering from a steering wheel (20, 120, 220) to a rudder (30, 130, 230), comprising a steering cable means for steering the rudder by transmitting the control quantity of operating the steering wheel to the rudder by reciprocal motion of said transmission line, wherein assisting force supplying means (70, 170, 270) is additionally installed for supplementing the manual force required to operate the steering wheel and an intermediate linkage rod (60, 160, 260) is installed to interpose in said transmission line, with the transmission line (L1) from the steering wheel and the transmission line (L3) to said rudder being linked to said intermediate linkage rod and the transmission line (L2) for the assisting force supplied from said assisting force supplying means is connected thereto, so that said intermediate linkage rod is moved back and forth by the sum of the manual force from the steering wheel and the assisting force from the assisting force supplying means, and the control quantity from said steering wheel is transmitted to the rudder, thereby steering the rudder, wherein the linkage point (P1) of the transmission line (L1) from the steering wheel (20, 120, 220) to the intermediate linkage rod (60, 160, 260) and the linkage point (P2) of the transmission line (L2) from the assisting force supplying means (70, 170, 270) are located apart from each other, and control means (90, 190, 290) is provided which, when there arises a deviation from the initial state in the positional relation between these linkage points due to the operation of the steering wheel, directs said assisting force supplying means to supply assisting force in such a direction that cancels said deviation, wherein the assisting force supplying means (70, 170, 270) includes at least a motor (71, 171, 271), a speed reducer (72, 172, 272) and a mechanism (74, 174, 274) which transforms the rotary motion of said motor into reciprocal motion.

3. The steering apparatus according to claim 2, wherein control of the assisting force supplying means (70, 170, 270) by the control means (90, 190, 290) is feedback control which includes proportional operation of controlling the magnitude of the assisting force in proportion to the magnitude of deviation.

4. The steering apparatus according to claim 3, wherein control of the assisting force supplying means (70, 170, 270) by the control means (90, 190, 290) is feedback control which includes integrating operation, in which the deviation is integrated and added, in addition to the proportional operation.

5. The steering apparatus according to claim 4, wherein control of the assisting force supplying means (70, 170, 270) by the control means (90, 190, 290) is feedback control which includes derivative operation, in which the deviation is differentiated and added, in addition to the proportional operation and the integrating operation.

* * * * *